United States Patent [19]

Miller, Jr.

[11] 4,157,096

[45] Jun. 5, 1979

[54] APPARATUS FOR CLEANING THREADED PIPE ENDS

[75] Inventor: John A. Miller, Jr., Houston, Tex.

[73] Assignee: AMF Incorporated, White Plains, N.Y.

[21] Appl. No.: 916,684

[22] Filed: Jun. 19, 1978

[51] Int. Cl.[2] ..... B08B 3/02; B08B 9/02

[52] U.S. Cl. ..... 134/111; 134/24; 134/168 C; 15/104.03

[58] Field of Search ..... 134/22 C, 24, 166 C–169 C, 134/170, 199, 111; 15/104.03

[56] References Cited

U.S. PATENT DOCUMENTS

| | | | |
|---|---|---|---|
| 1,704,364 | 3/1929 | Markley | 134/168 C X |
| 1,807,114 | 5/1931 | Wright et al. | 134/168 C X |
| 3,104,407 | 9/1963 | Volk | 134/170 X |
| 3,295,538 | 1/1967 | Williams, Jr. | 134/111 |
| 3,436,783 | 4/1969 | McCartney | 15/104.03 |
| 4,011,617 | 3/1977 | Toelke et al. | 134/168 C X |

*Primary Examiner*—Robert L. Bleutge

*Attorney, Agent, or Firm*—George W. Price; Charles J. Worth

[57] ABSTRACT

Apparatus for cleaning pipe ends having a closed system, for recycling cleaning fluid by removing contaminants, which includes independently positionable pin end and box end wash heads each of which can be used alone or simultaneously with the other; each wash head providing a high pressure spray of cleaning fluid impinging on the exposed threads of the pipe end being washed within a sealed wash chamber formed by the wash head.

10 Claims, 5 Drawing Figures

APPARATUS FOR CLEANING THREADED PIPE ENDS

This invention relates generally to apparatus for cleaning tubular members and more particularly for cleaning threaded pipe ends.

Although the present invention has utility in cleaning pipes for any purpose, it is particularly adapted for cleaning the pin and box ends of pipes used in the petrochemical field. For the most part, cleaning ends of pipes used for petrochemicals here-to-fore was accomplished manually with a brush and solvent. The solvent was not reused and this means left an oil film or residue on the threads. More sophisticated equipment for cleaning pipe ends has been proposed as shown in U.S. Pat. Nos. 3,436,783; 3,987,963 and 4,011,617. This equipment, however, contemplates the use of motor driven rotating brushes or cleaning heads. No provision is made to recycle the cleaning fluid or to prevent the cleaning fluid from washing contaminants further into a pipe from its threaded ends. While the Toelke et al apparatus of U.S. Pat. No. 4,011,617 teaches the capability of simultaneous cleaning a single end of two pipes to be joined together it lacks the capability of simultaneously cleaning both ends of a single pipe length.

Accordingly, an object of the present invention is to provide pipe end cleaning apparatus with a closed recycling cleaning fluid system capable of cleaning the pin or box end of a pipe or simultaneously cleaning the pin end of one pipe and the box end of another pipe or both the pin and box lengths of a single pipe.

Another object of the present invention is to provide the foregoing apparatus which cleans the pipe ends with high pressure streams of reuseable cleaning fluid.

And another object of the present invention is to provide separate heads for washing the pin ends and the box ends; each of the wash heads being provided with pipe centering means and seal means to prevent spent cleaning fluid with contaminants from flowing inwardly from the end being cleaned further into the pipe.

The foregoing and other objects and advantages will appear more fully hereinafter from a consideration of the detailed description wherein several embodiments of the invention are illustrated by way of example. It is to be expressly understood, however, that the drawings are for illustration purposes only and are not to be construed as defining the limits of the invention.

Figure 1:
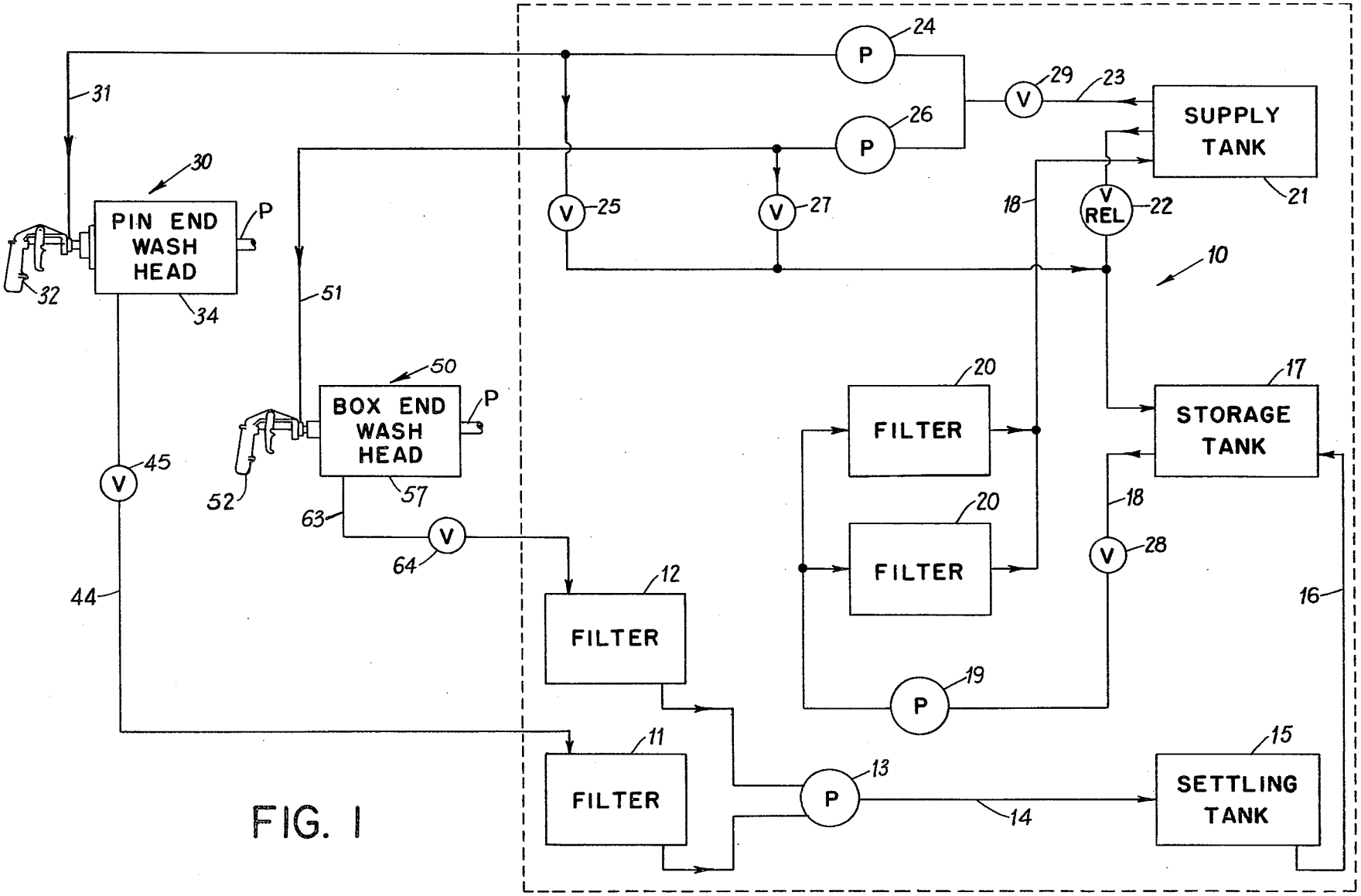
FIG. 1 is a diagrammatic illustration of apparatus made in accordance with the present invention.

Referring now to the drawings and particularly to FIG. 1, a closed recirculating system 10 for the pipe cleaning fluid, in accordance with the present invention, is preferably assembled and mounted on a base (not shown) which may be installed at a fixed location or mounted on a transportable chassis for field use.

The inlet of the system 10 for used pipe cleaning fluid, which may be any good cleaning solvent such as Naptha or mineral spirits, is formed by a pair of suitable commercial type screen or settling filters 11 and 12 which are connected to receive the used cleaning fluid from a pin end wash head or assembly 30 and a box end wash head assembly 50, respectively. The outlets of both filters 11 and 12 are connected to the inlet of a pump 13 which delivers filtered fluid via a line 14 to the inlet of a setling tank 15. The action of the filters 11 and 12 with the settling tank 15 removes substantially all of the solid contaminants, such as grit and sand, which are washed out of the pipe ends by the cleaning fluid. The filtered cleaning fluid is then delivered from the settling tank 15 via a line 16 to a storage tank 17.

Cleaning fluid from the storage tank 17 is delivered by a pump 19 via a line 18 to a supply tank 21. At least one and preferably a pair of filters 20, as shown, of approximately 125 micron, are connected in parallel in line 18 to remove oil and grease from the cleaning fluid. Pump 19 is intended to maintain a low pressure of approximately 7 to 10 P.S.I. in the supply tank 21 which is provided with a pressure relief 22 connection back to the supply tank 17, should the internal supply tank pressure rise above a desired maximum limit. The outlet of the supply tank 21 is connected by a line 23 to the inlets of a pair of feed pumps 24 and 26.

Although not shown, the pump 19 may be driven on demand by providing tank 21 with a pressure responsive switch for controlling the drive for the pump 19 in place of the relief connection 22. When the pressure in the tank 21 reached its desired maximum, the pressure switch would open and stop the pump 19 from being driven. When pumps 24 and/or 26 are operating drawing fluid from tank 21, the internal tank pressure will drop causing the pressure switch to close and pump 19 to be driven.

The low pressure in the supply tank 21 is primarily to prevent inlet cavitation of pumps 24 and 26. Lines 18 and 23 are preferably provided with manual shut-off valves 28 and 29, respectively, to maintain pressure in the tank 21 when the system is shut down and to facilitate work on the system. The discharges of pumps 24 and 26 are provided with unloader connections 25 and 27, respectively, back to the storage tank 17.

The pin end wash head 30 and the box end wash head 50 are portable so that they can be moved by an operator and fitted over an appropriate end of a pipe P to be cleaned. The pin end wash head 30 is provided with a trigger type valve 32 connected by a line 31 to the output of pump 24 which provides fluid under pressure for cleaning pin ends of pipes. The flow of pressure fluid through line 31 is controlled by the trigger valve. The outlet of the pin end wash head 30 for used cleaning fluid is connected to the inlet of the filter 11 by a line 44 provided with a shut-off valve 45 which can be closed when the pin end wash head is not used.

The box end wash head 50 also is provided with a trigger type valve 52 connected by a line 51 to the output of pump 25 which provides fluid under pressure for cleaning box ends of pipes. The flow of pressure fluid through line 51 is controlled by the trigger valve. The outlet of the box end wash head 50 for used cleaning fluid is connected to the inlet of the filter 12, by a line 63 provided with a shut-off valve 64 which can be closed when the box end wash head is not used.

For portability of the wash heads 30 and 50, the high pressure cleaning fluid inlet lines 31 and 51 and used cleaning fluid discharge lines 44 and 63 are preferably drum wound extendable hoses or any suitable equivalents.

Figure 2:
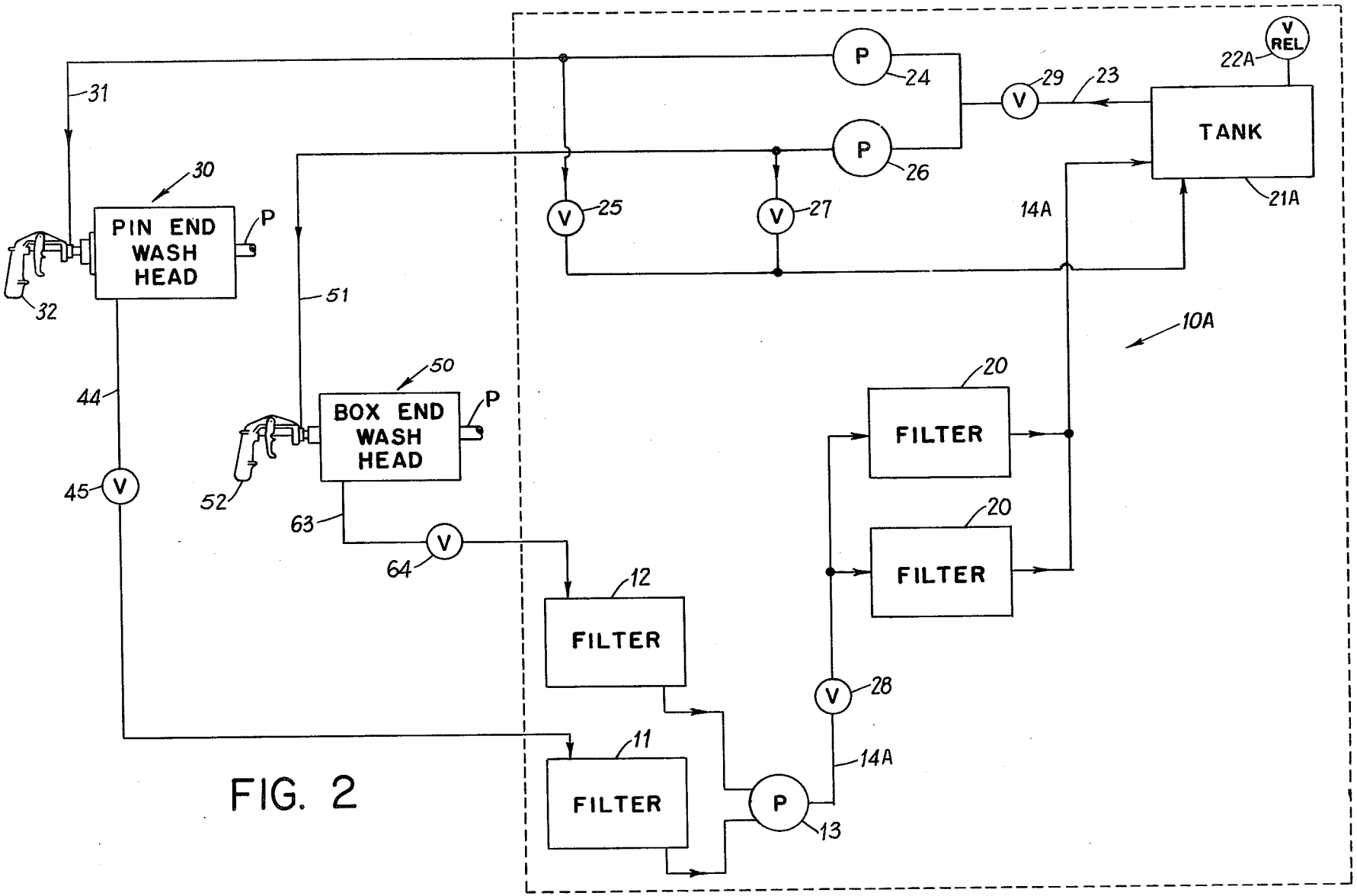
FIG. 2 is a diagrammatic illustration of apparatus with a modified fluid system made in accordance with the present invention.

In FIG. 1, the tank means for the cleaning fluid of the recirculating system 10 is formed by the settling tank 15, the storage tank 17 and the supply tank 21. Where space availability permits, a single large tank may be used. Referring now to FIG. 2, a modified recirculating system 10A is provided with a single large tank 21A in place of the three tanks 15, 17 and 21. The discharge pump 13 is now connected by line 14A to the inlet of tank 21A. A filter or preferably a pair of filters 20 are now connected in parallel in the line 14A which also is provided with the shut-off valve 28.

In place of the pressure relief connection 22 of system 10, the tank 21A is provided with a pressure relief or blowoff 22A which communicates with the inside of the tank above the maximum fluid level. The unloader valves 25 and 27 for pumps 24 and 26, respectively, are now connected to tank 21A instead of the storage tank 17 of the system 10.

Figure 3:
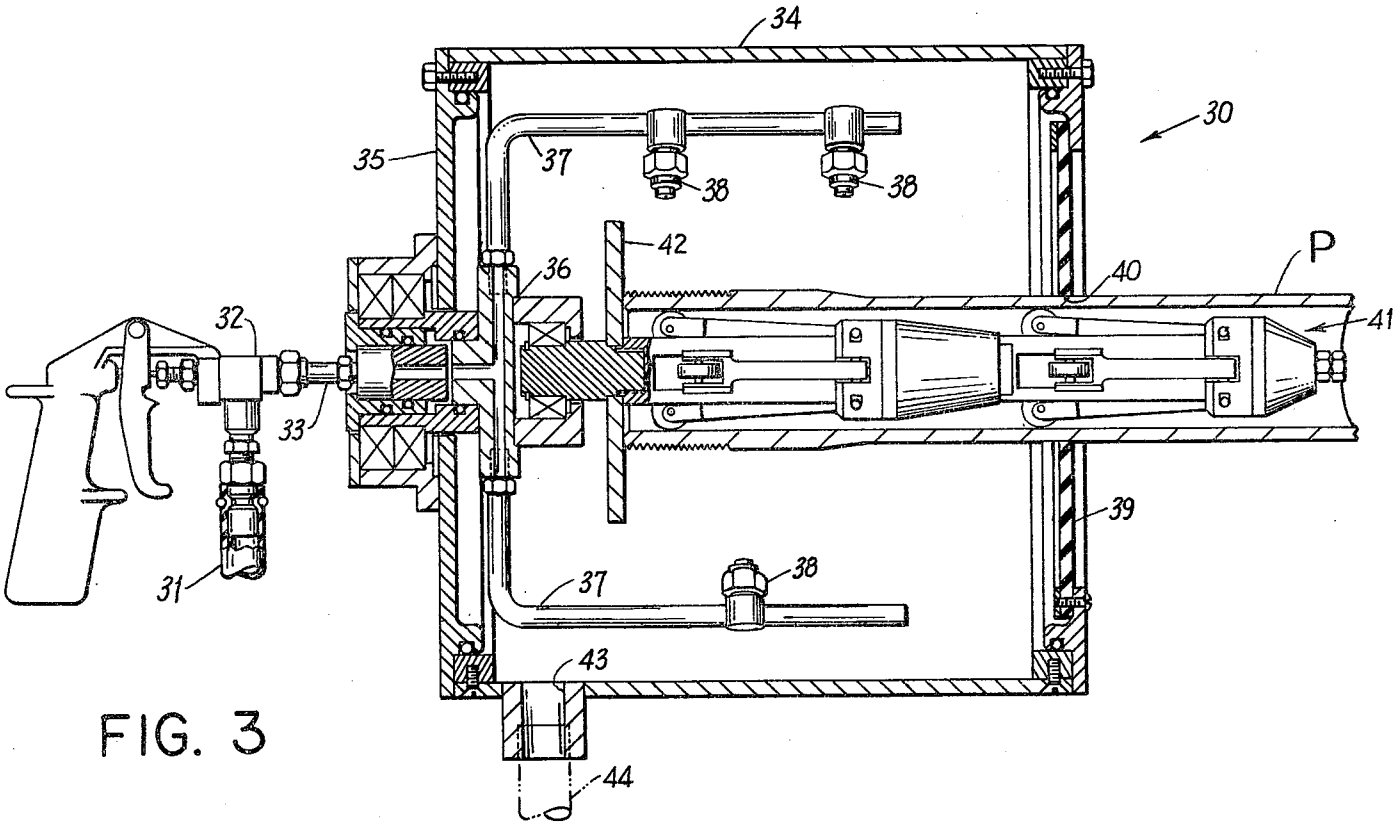
FIGS. 3 and 4 are enlarged sectional views of the pin end and box end wash heads of FIG. 1.

As shown in detail in FIG. 3, the pin end wash head 30 is provided with a tubular housing 34 with a rigid wall 35 connected to one end thereof and a resilient or elastic wall 39 connected to its other end. The trigger type valve 32 has a discharge 33 connected through centrally disposed gland mounted on the wall 35 to a rotatable yoke 36 which is supported by the gland, while the wall 39 is provided with a central opening 40 which is axially aligned with the gland and axis of rotation of the yoke 36. A non-rotatable pipe centering and support means 41, of any suitable type, is connected at one end by a bearing to the yoke 36 and extends axially therefrom and through the opening 40 of the wall 39. The centering and support means 41 is provided with a plate type seal 42 adjacent to the yoke 36.

The yoke 36 which receives the flow of cleaning fluid from the valve discharge 33 axially through the gland divides the fluid into two transverse flows each in a direction away from the other, and is provided with two tubular L-shaped arms 36 for directing the transverse flows from the yoke to a plurality of spray nozzles 38. The arms 37 initially extend away from one another toward the tubular housing 34, and then parallel to one another toward the wall 39. One of the arms 31 is provided with an axially spaced pair of spray nozzles 38 while the other arm 27 is provided with a single spray nozzle 38 axially disposed between the pair of spray nozzles. The spray nozzles 38 extend inwardly from arms 37 toward the pipe centering and support means 41 and are offset from being radial only to a degree sufficient to create a reaction force from the spray which causes the yoke 36 with arms 37 and nozzles 38 to rotate.

For cleaning, the centering and support means 41 is inserted into the pin end of a pipe P until the pipe end surface engages the plate seal 42 which prevents the cleaning fluid from entering the pipe. The pipe end extends through the opening 40 and the surrounding material of the resilient or elastic wall 39 forms a fluid seal with the outer pipe surface. The tubular housing 34 is provided with an outlet port 43 for connection of the line 44.

Figure 4:
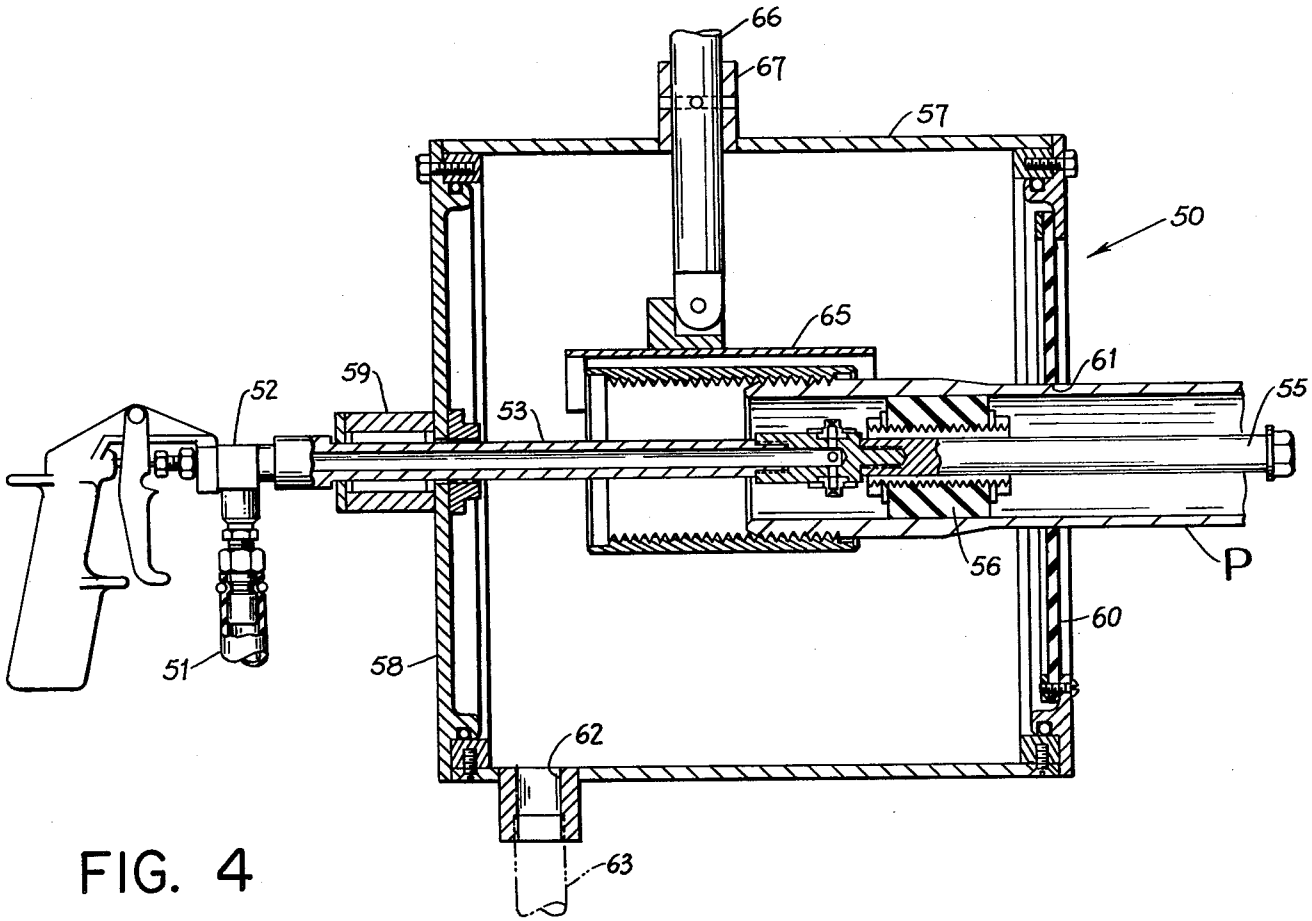

The box end wash head 50 is intended for use with smaller diameter pipes with insufficient internal space available to accommodate a reaction type rotatable spray as is provided by the yoke 36, arms 37 and nozzles 38 of the wash head 30. As is shown in FIG. 4, the wash head 50 is provided with a tubular housing 57 with a rigid wall 58 connected to one end thereof and a flexible or elastic wall 60 connected to one end thereof and a flexible or elastic wall 60 connected to its other end which correspond to the housing 34 and wall 35 and 39 of the wash head 30. A suitable gland assembly 59 is centrally mounted on the wall 58 and is axially aligned with a central opening 61 in the wall 60. The housing 57 is provided with a suitable port 62 for the connection of the discharge line 63 for used cleaning fluid.

A tubular lance 53 which is connected at one end to the discharge of the trigger valve 52, extends through the gland 59 and is provided with a fitting with four spray nozzles 54 at its other end. An extension member or lance extension 55 is connected to the end fitting of the lance 53 and mounts a plug member 56 which is slidable thereon. A centering and support member 65 with a stop 66 is disposed in the housing 57 and is provided with an adjusting rod 68 which extends through a collar 67 for movement toward and away from the lance 53 to be appropriately positioned for accommodate pipes of various sizes.

For cleaning, the lance extension 55 is inserted into the box end of a pipe P until the end of the box engages the stop 66. In this condition, the pipe P extends through the opening 61 and the surrounding material of the resilient or elastic wall 60 forms a seal with the outer pipe surface, the plug 56 in its rearmost position on the lance extension 55 is disposed in the pipe P and forms a seal with the inner pipe surface, and the lance 53 is in its forward most position with the nozzles 54 disposed in the end of the pipe. The trigger valve 52, the lance 53 and lance extension 55 can now be moved as a unit relative to the housing 57, axially to move the spray nozzles 54 into the box. It should be noted that while the rotatable spray of wash head 30 (FIG. 3) is provided with three nozzles 38, the lance 53 is provided with four nozzles 54 which are spaced 90° apart. However, the trigger valve 52 and lance 53 is capable of limited rotation relative to the housing 57, and with axial movement of the nozzles 54, the spray of cleaning fluid will contact the entire exposed threads of the box.

Figure 5:
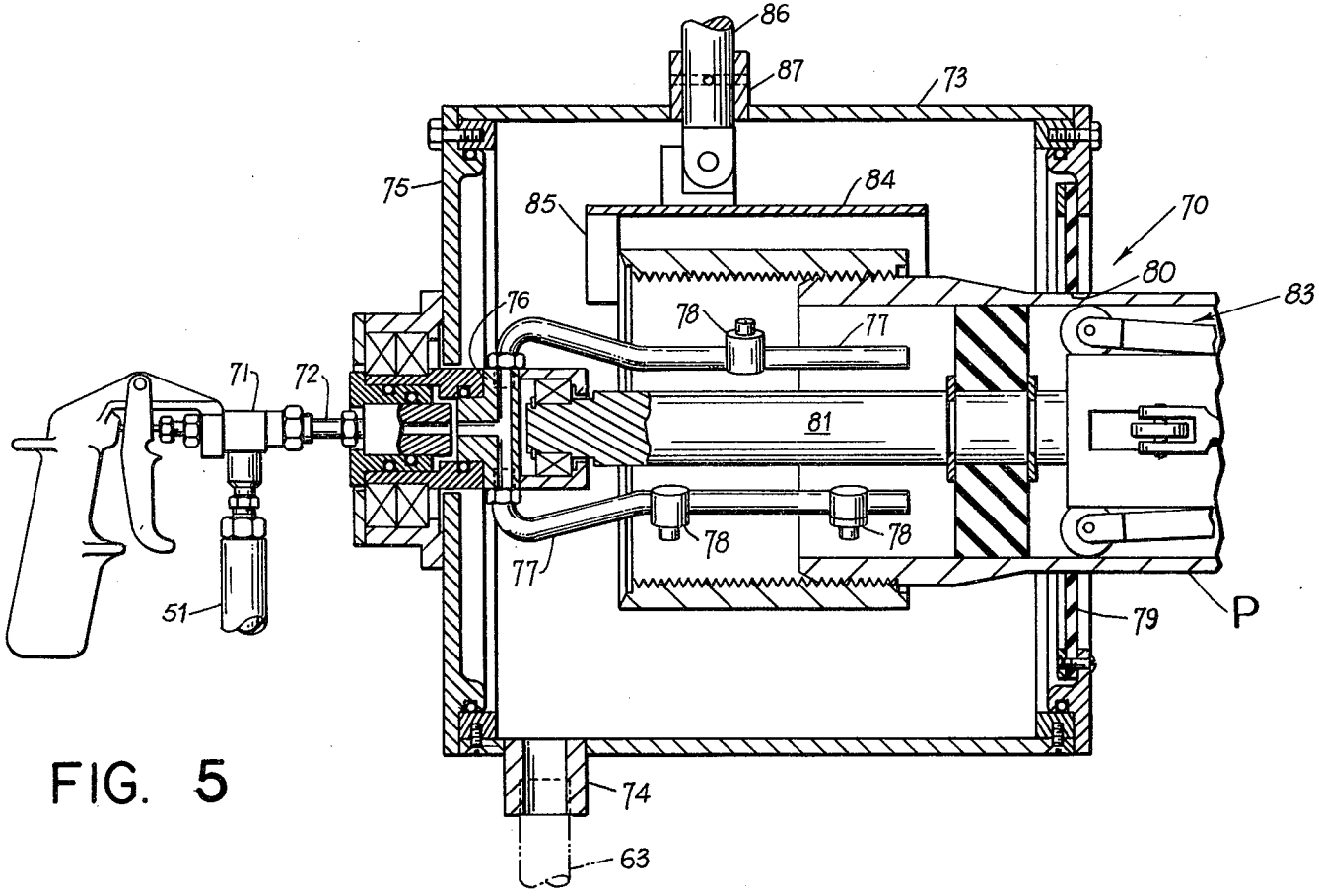
FIG. 5 is a section view similar to FIGS. 3 and 4 of a modified box end wash head.

While the wash heads 30 and 50 can be used with a wide range of pipe sizes by mearly changing the respective resilient or elastic walls 39 and 60 with appropriate size openings 40 and 61, respectively, it may be considered to be desirable to provide a box end wash head with a reaction type rotatable spray for larger sizes of pipe. Accordingly, a modified box end wash head 70 is shown in FIG. 5 which is constructed very similar to the wash heads 30 and 50.

As shown, the wash head 70 is provided with a trigger type valve 71 having its inlet adapted for connection to the delivery line 51 and its discharge 72 connected through a central gland mounted on a rigid end wall 75 for providing an axial flow of cleaning fluid to a rotatable yoke 76 which divides the axial flow into two transverse flows each in a direction away from the other. The rigid wall 75 is connected to one end of a tubular housing 73 having a port 74 which is adapted to be connected to the discharge line 63. A resilient or elastic wall 79 is connected to the other end of the housing 73 and is provided with a central opening 80 axially aligned with the yoke 76.

In the wash head 30, the non-rotatable pipe centering and support means 41 is connected to the yoke 36 by a stub shaft or connector on which is fixedly mounted a plate seal 42. In the modified wash head 70, a non-rotatable pipe centering and support means 83, which extends through the opening 80, is connected to the yoke 76 by an extended or elongated shaft or connector 81 upon which is fixedly mounted, adjacent to the pipe centering and support means 83, a plug type seal 82 corresponding to the plug type seal 56 of wash head 50.

The yoke 76 is provided with a pair of tubular arms 77 with spray nozzles 78 which correspond generally to arms 37 and nozzles 38, respectively. While the arms 37 extend axially adjacent the housing 34 and the spray nozzles 38 facing inwardly, in the modified wash head 70 the tubular arms 77 extend axially adjacent to shaft 81 and the nozzles 78 face outwardly toward the housing 73.

Stop means are required to properly position a pipe to be washed and any suitable means may be provided. It may be advantageous, as in the wash head 50, to provide a centering and support means 84 with a stop 85 having an adjusting or positioning rod 85 extending through a collar 87. Alternatively, when the centering and support means 84 is provided, the centering and support means 83 may be eliminated. As with the wash head 50, the material of the flexible or elastic wall 79 surrounding the opening 80 forms a seal with the outer pipe surface and the plug 82 forms a seal with the inner pipe surface.

Therefore, each of the wash heads 30, 50 and 70 provides a sealed wash chamber and seal the end being washed from the remaining interior of the pipe. The normally closed trigger valves 32, 52 and 71 block high pressure flow through delivery lines 31 and 51, and closing shut-off valves 45 and 64 will block return flow from the pin end wash head 30 and the box end wash head 50 or 70. By selective opening of the valves, only the pin end wash head 30 or the box end wash head 50 or 70 can be used, or the pin end wash head can be used simultaneously with a box end wash head 50 or 70, depending upon the size of the pipe.

Although several embodiments of the invention have been illustrated and described in detail, it is to be expressly understood that the invention is not limited thereto. Various changes may also be made in the design and arrangement of the parts without departing from the spirit and scope of the invention as the same will now be understood by those skilled in the art.

What is claimed is:

1. Apparatus forming a closed fluid system for cleaning the ends of pipes, comprising a wash head for cleaning the pin end of a pipe defining a sealed wash chamber when a pipe end is disposed therein, and having a manually operable valve for controlling the flow of cleaning fluid to said wash chamber;

a wash head for cleaning the box end of a pipe defining a sealed wash chamber when a pipe end is disposed therein, and having a manually operable valve for controlling the flow of cleaning fluid to said wash chamber;

each of said wash heads having means for spraying the flow of cleaning fluid against the pipe end disposed therein and seal means for preventing the cleaning fluid from flowing from the pipe end being cleaned into the pipe toward its other end;

tank means for the cleaning fluid;

filter means for removing contaminants from the cleaning fluid after use in said wash heads;

first pump means causing the used cleaning fluid to flow from said wash head through said filter means to said tank means; and second pump means for providing cleaning fluid under pressure from said tank means to said manually operable valves.

2. The apparatus in accordance with claim 1, and each of said wash heads being provided with centering and support means engaging a pipe end disposed in said wash head.

3. The apparatus in accordance with claim 2, and each of said manually operable valves being normally closed; and two shut-off valves each being manually operable for closing off flow of used cleaning fluid from a different one of said wash heads.

4. The apparatus in accordance with claim 3, and said seal means of one of said wash heads being mounted on said centering and support means;

said spraying means of said one of said wash heads being a reaction type rotatable spray with at least two parallel arms; and each of said arms having at least one spray nozzle positioned to direct cleaning fluid toward the pipe end disposed in said wash head.

5. The apparatus in accordance with claim 4, and said one of said wash heads being said wash head for cleaning the pin end of a pipe;

said seal means engaging the end of a pipe disposed in said wash head and forming a stop for said pipe; and said nozzles being positioned to direct the cleaning fluid inwardly against the outer surface of the pin end of the pipe disposed in said wash head.

6. The apparatus in accordance with claim 4, and said one of said wash heads being said wash head for cleaning the box end of a pipe;

said nozzles being positioned to direct the cleaning fluid outwardly against the inner surface of the box end of the pipe disposed in said wash head; and said seal means forming a plug inwardly in the pipe from the ends of said arms.

7. The apparatus in accordance with claim 6, and an adjustable centering and support means engaging the outer surface of the box end of a pipe disposed in said wash head and having a stop member for limiting the axial position of the pipe end.

8. The apparatus in accordance with claim 3, and said wash head for cleaning the box end of a pipe further comprising rodlike means extending axially into the box end of a pipe disposed in said wash head;

said spray means disposed in the box end of a pipe in said wash head directing cleaning fluid outwardly against the inner surface of the pipe;

said seal means forming a plug mounted on said rodlike means inwardly in the pipe from said spray means; and said centering and support means engaging the outer surface of the box end the pipe disposed in said wash head and having a stop member for limiting the axial position of the pipe end.

9. The apparatus in accordance with claim 8, and said spray means being a reaction driven rotatable spray comprising a rotatable yoke;

a pair of tubular arms connected to said yoke and extending parallel to one another into the box end of a pipe disposed in said wash head; and each of said arms being provided with at least one nozzle positioned to direct the cleaning fluid against the inner surface of the box end.

10. The apparatus in accordance with claim 8, and said wash head having a rigid wall and a gland centrally mounted on said wall;

a tubular lance connected at one end to said manually operable valve for receiving cleaning fluid therefrom;

said lance extending through said gland into the box end of a pipe disposed in said wash head and having a plurality of arcuately spaced spray openings in its end in the pipe box end forming said spray means;

a rodlike extension member connected to the spray end of said lance, and said seal means movably mounted on said extension member; and said lance and said extension member being movable in unison axially thereby moving the spray means along the box end of the pipe while permitting said seal means to remain in place.

* * * * *